United States Patent [19]

Beck et al.

[11] 4,301,389

[45] Nov. 17, 1981

[54] MULTIPLE BEAM CATHODE RAY TUBE WITH APERTURED CATHODE AND CONTROL GRID

[75] Inventors: Vernon D. Beck, Ridgefield, Conn.; Bruce P. Piggin, Sherfield English, England; Arthur E. Uber, III, Pittsburgh, Pa.

[73] Assignee: International Business Machines Corp., Armonk, N.Y.

[21] Appl. No.: 102,794

[22] Filed: Dec. 12, 1979

[51] Int. Cl.[3] ..... H01J 29/50

[52] U.S. Cl. ..... 313/411; 313/413; 313/414; 313/417

[58] Field of Search ..... 313/411, 414, 417, 412, 313/413, 409, 495, 410

[56] References Cited

U.S. PATENT DOCUMENTS

| | | | |
|---|---|---|---|
| 2,005,330 | 6/1935 | Sukumlyn | 313/411 X |
| 2,956,194 | 10/1960 | Alma et al. | 313/495 |
| 3,214,632 | 10/1965 | Harman | 315/14 |
| 3,748,514 | 7/1973 | Standaart | 313/410 |
| 4,121,130 | 10/1978 | Gange | 313/409 X |

*Primary Examiner*—Palmer C. Demeo

*Attorney, Agent, or Firm*—Pollock, Vande Sande & Priddy

[57] ABSTRACT

A multiple beam cathode ray tube having an improved cathode-grid structure which facilitates grid lead connections and mounting. The cathode means has a plurality of openings which are arranged in an array pattern which is identical to the desired electron beam array pattern, and has an emitter means associated with each opening for emitting a group of electrons. The grid means is located behind instead of in front of the cathode means and is comprised of a plurality of grid elements mounted on a substrate. When appropriately biased, the grid elements cause groups of electrons which are emitted by the respective emitter means to flow through the corresponding openings in the cathode in the direction of the screen, thus establishing the required electron beams.

14 Claims, 6 Drawing Figures

MULTIPLE BEAM CATHODE RAY TUBE WITH APERTURED CATHODE AND CONTROL GRID

FIELD OF THE INVENTION

The present invention is directed to multiple beam cathode ray tubes, and more particularly to an improved cathode-grid structure for such a tube which facilitates grid lead connections and mounting.

BACKGROUND OF THE INVENTION

Multiple beam cathode ray tubes are frequently used to display alphanumeric and/or other visual pattern information. Such tubes have greater bandwidth than single beam tubes, which enables them to display more information at suitable brightness than the single beam type.

Typically, the multiple beam tubes utilize a plurality of electron beams which are arranged in an array. Accelerating means, focussing means and deflection means are disposed in or on the envelope of the cathode ray tube, and after being accelerated and focussed, the beams are deflected across the screen while repeatedly being turned on and off so as to form "dots" on the screen at respective scanning positions. In order to form the desired characters or other patterns, logic circuitry selectively controls each beam to be either on or off at each scanning position, and the resulting arrangement of "dots" forms the desired pattern.

The usual cathode-grid structure in such a multiple beam tube consists of a sheet cathode which emits electrons over its entire surface, and an array of grid elements disposed in front of the cathode. Each such grid element has a circular aperture therein for defining and passing an electron beam, and the apertures are collectively arranged in an array pattern which corresponds to the desired electron beam array pattern.

Such a cathode-grid structure has several inherent problems. Since each grid element must be individually controllable, a separate lead wire must be connected to each element. However, the leads to the respective elements must be kept distance from the apertures in adjacent grid elements as otherwise the electric fields around the leads will intermodulate adjacent electron beams. Further, since the spacing between adjacent grid elements is extremely small, typically given about 0.005", the leads cannot be run in these spaces, and since the entire grid may only be on the order of 1/10" on a side, appropriate positioning and connection of the leads is frequently extremely difficult.

Additionally, because of the above size considerations, the mechanical mounting of the grid elements is not easily accomplished. Since each element must be spaced from every other element, each must be separately supported in the tube. However, the space which is available for the mounting members may not be adequate for the effective and precise mounting which is required. Further, it should be noted that while these problems exist even when the array of electron beam sources is in a straight line pattern, they become more serious when a two dimensional source array, and a two dimensional grid array having a plurality of interior grid elements is employed.

SUMMARY OF THE INVENTION

It is therefore an object of the invention to provide a multiple beam cathode ray tube having a cathode-grid structure which facilitates the connection of leads to the grid elements.

It is a further object of the invention to provide a multiple beam cathode ray tube having a cathode-grid structure which facilitates the mounting of the grid elements in the tube.

It is still a further object of the invention to provide a multiple beam cathode ray tube in which beam intermodulation is reduced.

It is still a further object of the invention to provide a multiple beam cathode ray tube in which the electron sources are at common potential.

It is still a further object of the invention to provide a multiple beam cathode ray tube having a cathode, and a grid array, which are easy to manufacture.

It is still a further object of the invention to provide a multiple beam cathode ray tube having a cathode-grid structure which substantially reduces ion-bombardment damage to the cathode.

The above objects are accomplished by providing a cathode-grid structure in which the grid means is located behind instead of in front of the cathode means in the cathode ray tube envelope. The cathode means has a plurality of openings which are arranged in an array pattern which is identical to the desired electron beam array pattern, and further has an emitter means associated with each opening for emitting a group of electrons. The grid means is biased to direct each group of electrons through the opening corresponding thereto in the direction towards the cathode ray tube screen, thus establishing the respective electron beams.

In preferred embodiments of the invention, the openings in the cathode means are circular apertures, and each electron emitter means is comprised of a ring of electron emitting material which is mounted on an emitter means mounting substrate so as to encircle an aperture in the substrate. The grid means is comprised of an array of grid elements which are mounted on a grid mounting substrate with each grid element being opposite to an electron emitting ring. In one embodiment, the rings of emitting material are disposed around the peripheral wall of a portion of the circular apertures and in a further embodiment, they are disposed on the face of the cathode substrate which is opposite the grid elements.

In the arrangement of the invention, the grid leads are connected to the rear of the grid elements and are fed through holes in the grid mounting substrate to the rear of the substrate, and to a connection means at the rear of the tube. Hence, lead placement problems and the attendant possibility of intermodulation are substantially eliminated with the structure of the invention. Similarly, mounting of the grid elements is merely a matter of securing them to a unitary mounting substrate, which is then easily mounted in the tube, so that the difficult mechanical mounting problems of the prior art arrangement are avoided.

BRIEF DESCRIPTION OF THE DRAWINGS

The invention will be better understood by referring to the accompanying drawings, in which.

DETAILED DESCRIPTION OF PREFERRED EMBODIMENTS

Figure 1:
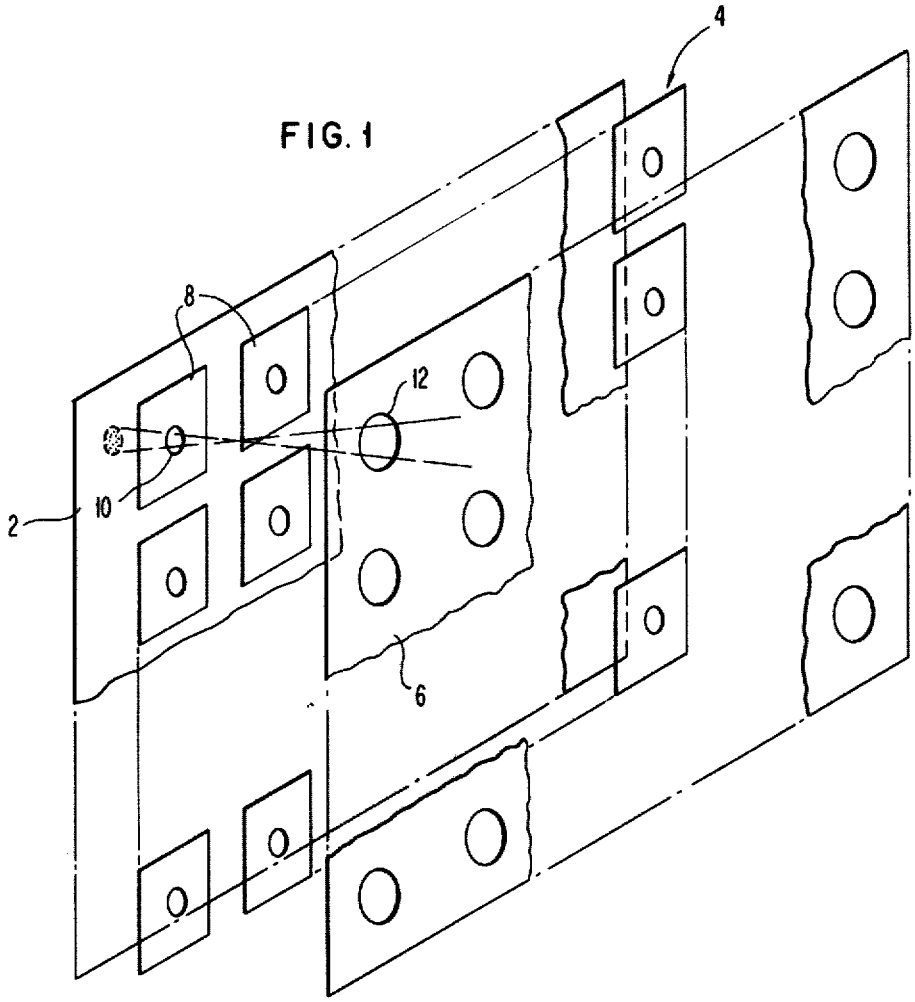
FIG. 1 is a schematic representation of a cathode-grid structure having disadvantages which are obviated by the present invention.

Referring to FIG. 1, a cathode-grid structure which might be used in a multiple beam cathode ray tube utilizing a two-dimensional electron beam array is shown. The structure is comprised of sheet cathode 2, control grid array 4, and shielding grid 6. Control grid array 4 is comprised of a plurality of flat or planar metallic elements such as elements 8 each having a circular aperture therein, such as aperture 10. Shielding grid 6 is a unitary planar element located directly in front of the control grid array and having a plurality of apertures such as aperture 12 which are disposed directly in front of the corresponding apertures of the control grid elements.

In the operation of the cathode-grid structure of FIG. 1, when sheet cathode 2 is heated, it emits electrons across its entire surface. These electrons are directed towards control grid array 4 and are focussed slightly ahead of the apertures in the grid elements, as shown in FIG. 1. The beams thus formed are directed through the apertures in shielding grid 6, as shown in the Figure.

Additionally, each grid element must have a wire lead connected thereto so that the potential applied to the respective elements can be individually controlled. Since the area between adjacent grid elements is very small (typically 0.005"), the leads cannot be placed in these spaces. Further, the leads must be as far away as possible from the electron beams coming through the apertures of adjacent grid elements, as otherwise intermodulation will occur, with the electric field around a wire modulating an adjacent beam.

There are several problems attendant to the cathode-grid structure shown in FIG. 1. As mentioned above, the placement and connection of the grid leads is extremely difficult. Since the entire grid array may be only 1/10" square or smaller, connecting the leads so as to avoid intermodulation may not be possible. Additionally, the mounting of the grid elements is a difficult mechanical problem. Both of these problems become more severe as the number of grid elements in the array increases, and while the invention has utility even in the case of a line array, it is of particular use where a two-dimensional configuration of grid elements is employed.

Figure 2:
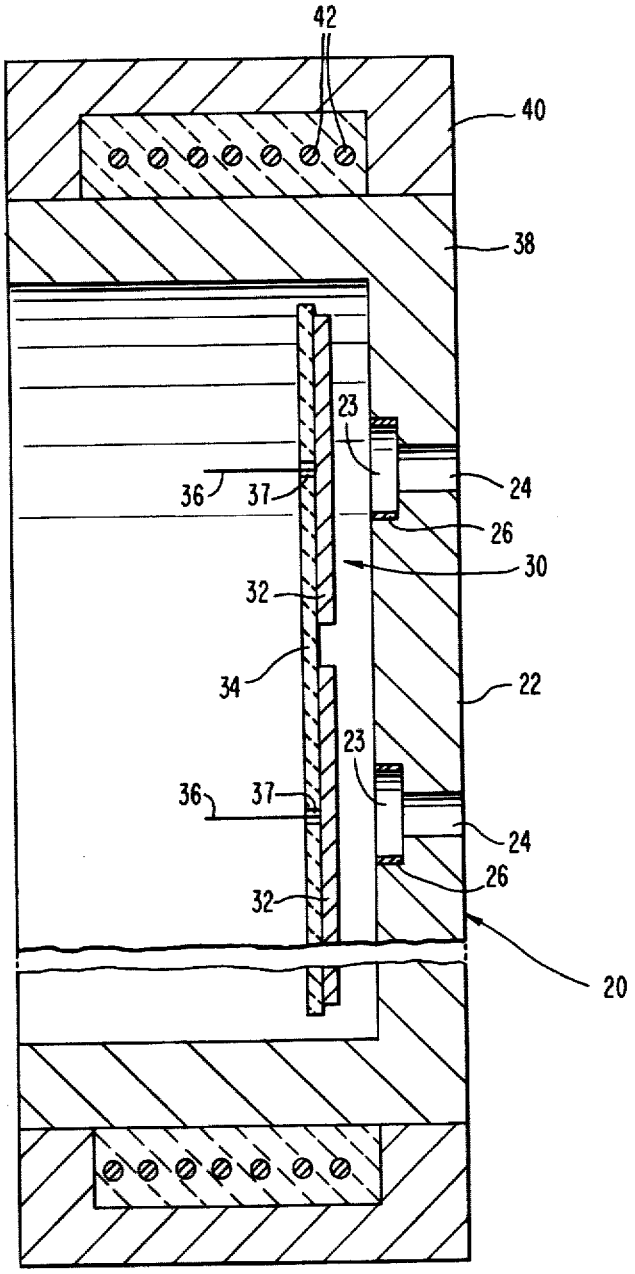
FIG. 2 is a partial cross-sectional view of a cathode-grid structure in accordance with an embodiment of the present invention.
Figure 3:
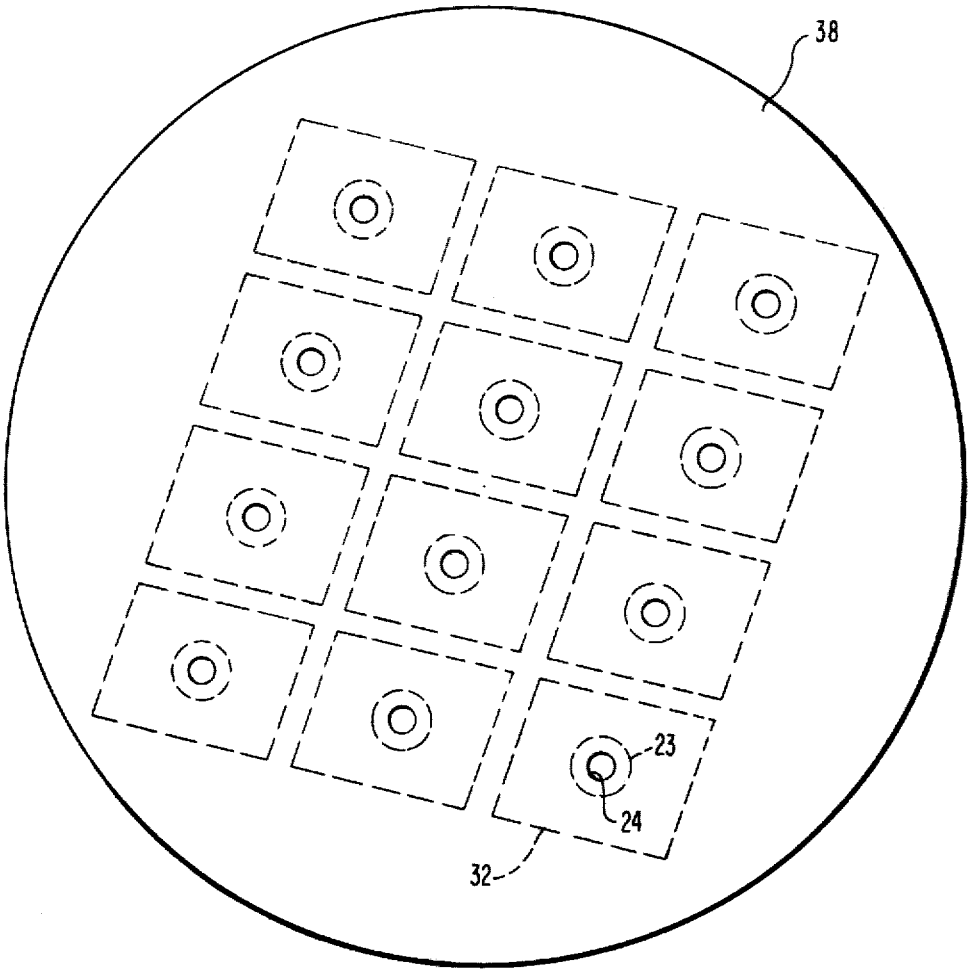
FIG. 3 is a front view of the cathode-grid structure shown in FIG. 2.

The above problems are obviated with the cathode-grid structure of the present invention, and an embodiment thereof is shown in FIGS. 2 and 3. Referring to these Figures, it will be seen that the cathode 20 is comprised of emitter means mounting substrate 22, and emitter means 26 which are mounted thereon. Substrate 22 has a plurality of circular apertures 24 therein which are arranged in the desired electron beam array pattern, and each emitter means is mounted so as to encircle an aperture. Each emitter means comprises an oxide layer of electron-emitting material and in the particular embodiment of the invention shown in FIG. 2, each circular aperture has a counterbored portion 23 of larger diameter than the rest of the aperture, and the oxide layer is coated on the walls of this larger diameter portion. Referring to FIG. 3, it will be seen that the grid array illustrated is for providing a square array of electron beams having three beams in a row and four beams in a column.

The control grid array 30 is located behind the cathode and is comprised of an array of grid elements 32 which are disposed on unitary grid-mounting substrate 34. In the preferred embodiment, as illustrated in FIG. 3, each control grid element is rectangular, and the spacing between the elements as in the prior art arrangement, is kept as small as possible. The grid leads 36 which are attached to each grid element are fed through holes 37 in substrate 34 to a connection means at the rear of the tube.

Figure 6:
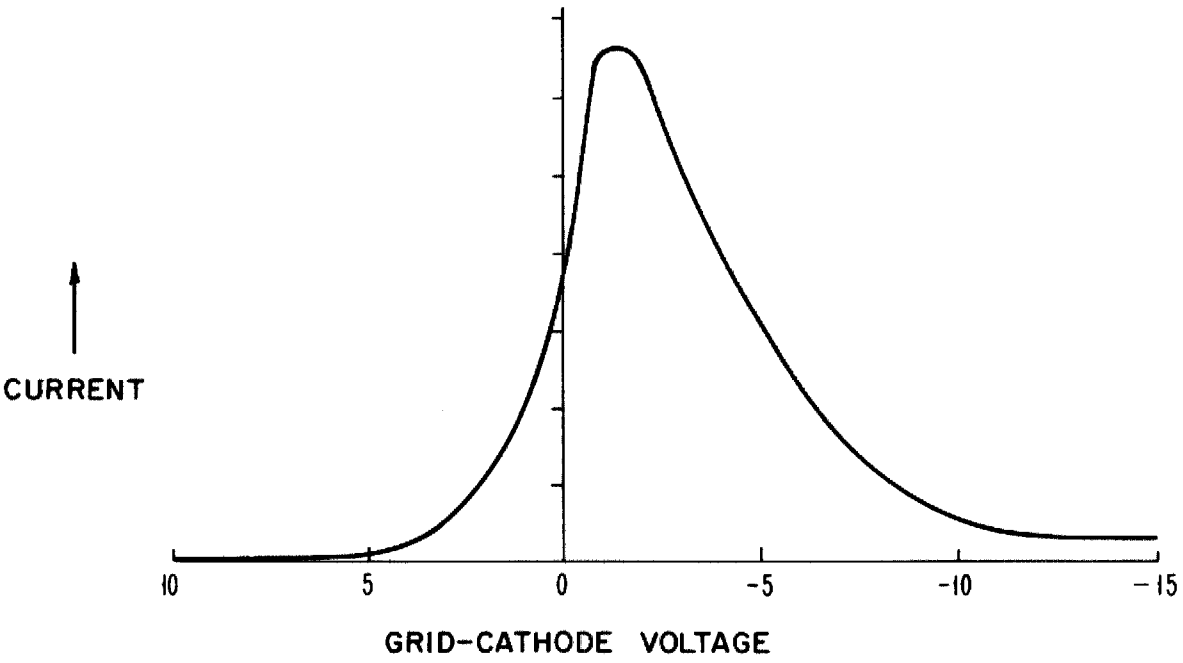
FIG. 6 is a graph of beam current versus grid-cathode voltage which is obtained with the structure shown in FIGS. 2 and 3.

Referring to FIG. 2, a structure comprised of concentric metallic cylindrical member 38 and cylindrical U-shaped member 40 encircle the array. Circularly shaped heater wires 42 are enclosed in the interior of the double-walled structure, and when excited with electricity, these wires heat the metallic cylinders, which in turn, heat the cathode substrate 22 by conduction. Upon attaining a certain temperature, each electron emitter means emits a group of electrons at all angles normal to the emitter surface. By suitable adjustment of the biasing on the grid elements, the electron beams may either be caused to flow through the apertures in the direction towards the anode, or may be cut off. Referring to the grid-cathode voltage characteristic shown in FIG. 6, it is seen that beam current will be attained with small negative grid-cathode voltages and very small positive grid-cathode voltages, but that large negative or positive grid-cathode voltages will result in cut-off. This is because large negative voltages repel the electrons back into the cathode while large positive voltages attract the electrons to the grid, which absorbs them. On the other hand, small negative and positive voltages direct electrons which may tend to drift back towards the grid through the cathode apertures, and towards the anode and the screen.

It has been found that the best beam control is attained by disposing the oxide emitter layer on the interior of a widened portion of the cathode aperture close to the grid, as shown in FIG. 2. When the oxide layer is located too far forward in the aperture, electrons are propelled forwards towards the anode irrespective of the grid voltage, and it becomes impossible to control the beam to cut-off.

Figure 4:
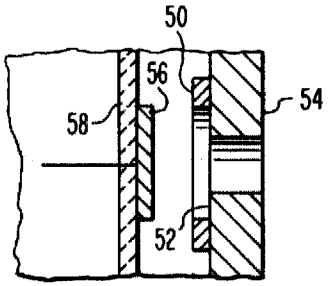
FIG. 4 is a partial cross-sectional view of a cathode-grid structure in accordance with a further embodiment of the present invention.

FIG. 4 is a cross-sectional view of a further embodiment of the invention, in which the electron emitting layers are disposed on a face of the cathode substrate instead of on the interior walls of the apertures. Referring to the Figure, it is seen that ring-shaped layer of electron emitting material 50 is disposed on face 52 of substrate 54. The grid array, which includes grid elements 56 and grid-mounting substrate 48, is similar to the grid array of FIG. 2. As in the embodiment of FIG. 2, locating the electron emitter to the rear of the cathode substrate ensures effective grid control.

Figure 5:
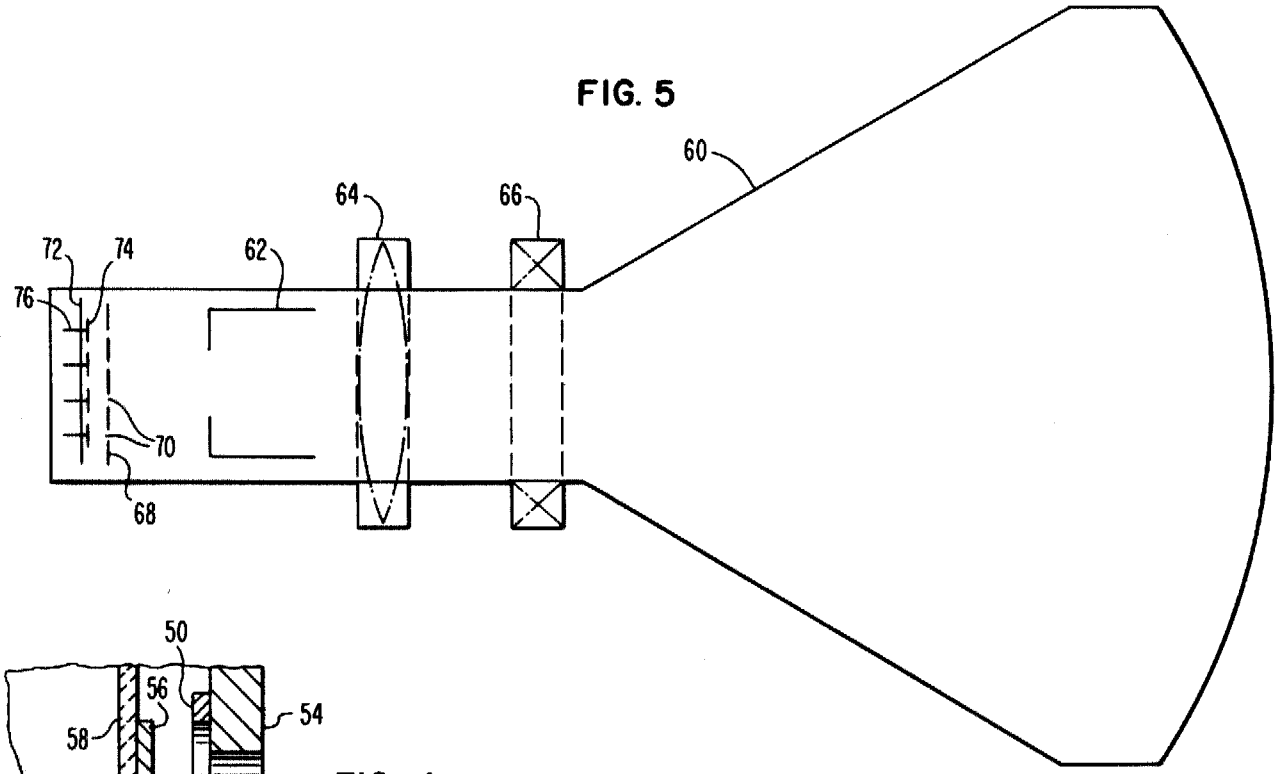
FIG. 5 is a schematic representation of a multiple beam cathode ray tube which incorporates the present invention.

FIG. 5 shows the cathode-grid structure of the invention disposed in a cathode ray tube. The tube is comprised of envelope 60 having accelerator 62 mounted therein and focussing means 64 and deflection means 60 mounted thereon. In accordance with the invention, cathode means 68 having apertures 70, and grid mounting substrate 72 having grid array elements 74 mounted thereon, are mounted in the envelope utilizing conventional techniques. The grid array is biased as described above, and the combination of the control grid and accelerator fields is effective to cause electron beams to flow through apertures 70, and to be accelerated to the screen of the tube. It is significant to note that grid leads 76 are fed through the back of substrate 72 to be connected at the rear of the tube, and that the grid lead connection problems of the prior art are therefore avoided. It should also be noted that no shielding grid is required with the arrangement of the invention, since the cathode itself performs a shielding function.

In an actual embodiment, the cathode substrate may be made of a metal, and a suitable material is nickel with traces of magnesium. The electron emitter material may be a conventional mixture of oxides, such as a mixture of barium, strontium, and calcium oxide. The grid array may be constructed of stainless steel, and should be mounted on an insulating substrate.

Exemplary dimensions which could be used in the cathode-grid structure are as follows: The diameter of the narrower portion of each aperture in the embodiment of FIG. 2 could be 0.075 mm. while the diameter of the wider portion of the aperture might be 0.125 mm. Typical spacing between the grid elements and the cathode substrate would be 0.1 mm. and a side of each grid element could be 0.15 mm. The thickness of the cathode substrate could be 0.1 mm while the thickness of the widened aperture portion could be 0.025 mm. It is to be understood that the above dimensions are included for purposes of illustration only, and that in practice a range of different dimensions could be used.

Further, it should be understood that while we have described preferred embodiments of the invention, we do not intend to be restricted thereto, but rather intend to cover all variations and modifications which come within the spirit of the invention, which is limited only by the claims which are appended hereto.

What is claimed is:

1. A multiple beam cathode ray tube wherein a plurality of electron beams form an image on the screen of the tube, and having a cathode-grid structure which substantially reduces grid mounting and grid lead-connection problems, comprising, a cathode ray tube envelope having a screen disposed at one end thereof, cathode means disposed in said cathode ray tube envelope near the other end thereof for emitting a plurality of physically separated groups of electrons, said cathode means having a plurality of openings therein wherein each opening corresponds to a said group of electrons, and grid means disposed in said envelope between said cathode means and said other end of said cathode ray tube envelope for directing each group of electrons which is emitted, through the opening which corresponds thereto in the direction of said screen, for establishing said plurality of beams which form said image.

2. The cathode ray tube of claim 1, which further includes accelerating means for accelerating said electron beams, focussing means for focussing said beams on said screen, and deflection means for deflecting said beams across said screen.

3. The cathode ray tube of claim 2 wherein said cathode means includes a plurality of electron emitter means, each for emitting one of said plurality of groups of electrons.

4. The cathode ray tube of claim 3 wherein said grid means comprises a plurality of independently excitable grid elements which are mounted on a common grid-mounting substrate, and each of which is disposed opposite one of said electron emitter means.

5. The cathode ray tube of claim 4 wherein said tube has a longitudinal axis and wherein said cathode means and said grid means are disposed perpendicular thereto, and wherein each grid element is comprised of a planar metallic element.

6. The cathode ray tube of claim 5 wherein each planar grid element has a larger surface area than the area bounded by a said emitter means.

7. The cathode ray tube of claim 6 wherein each grid element has a lead attached thereto, and wherein each of said leads is fed through a respective hole in said grid-mounting substrate to the rear thereof and to a connection means which is located in or on said cathode ray tube.

8. The cathode ray tube of claim 7 wherein said cathode further includes an emitter means mounting substrate, said plurality of electron emitter means being disposed on said substrate, and said emitter means and said substrate both having said openings.

9. The cathode ray tube of claim 8 wherein each of said electron emitter means comprises a ring of electron emitting material.

10. The cathode ray tube of claim 9 wherein said openings in said emitter means mounting substrate are circular apertures and wherein each ring of electron emitting material is disposed around one of said apertures.

11. The cathode ray tube of claim 9 wherein each said circular aperture has a counterbored portion therearound facing a said grid element, which portion is of greater diameter than the rest of said aperture, and wherein each ring of electron emitting material is disposed around the interior peripheral wall of said countersunk portion of one of said apertures.

12. The cathode ray tube of claim 10 wherein each said ring of electron emitting material is disposed on the face of said emitter means mounting substrate which is opposite said grid means.

13. The cathode ray tube of claims 3 or 10 wherein each of said plurality of electron emitter means and said plurality of grid elements are arranged in identical two dimensional array patterns.

14. The cathode ray tube of claim 13 wherein said identical two dimensional array patterns are squares.

* * * * *